United States Patent [19]

Wood

[11] 4,339,032

[45] Jul. 13, 1982

[54] BOTTLE CARRIER WITH PERIPHERAL SKIRT

[75] Inventor: Prentice J. Wood, Hapeville, Ga.

[73] Assignee: The Mead Corporation, Dayton, Ohio

[21] Appl. No.: 205,533

[22] Filed: Nov. 10, 1980

[51] Int. Cl.[3] ..... B65D 85/62; B66C 1/10; B65D 75/00

[52] U.S. Cl. ..... 206/158; 206/427; 294/87.2; 229/52 BC

[58] Field of Search ..... 206/148, 158, 199, 427; 294/87.2, 87.26; 229/52 BC, 52 B

[56] References Cited

U.S. PATENT DOCUMENTS

| | | | |
|---|---|---|---|
| 2,329,800 | 9/1943 | Warren | 229/52 BC |
| 2,355,730 | 8/1944 | Inman | 229/52 B |
| 2,959,337 | 11/1960 | Crane, Jr. | 229/52 B |
| 3,387,879 | 6/1968 | Wood | 206/158 |
| 3,410,596 | 11/1968 | Slevin, Jr. | 206/158 |

*Primary Examiner*—William T. Dixson, Jr.
*Attorney, Agent, or Firm*—Erwin Doerr

[57] ABSTRACT

This invention relates to a bottomless bottle carrier for a pair of bottles and which comprises a pair of side walls flanking wall portions of the bottles, the side walls having mutually inclined upper portions hinged together to provide a top wall, the top wall having a bottle-neck receiving aperture for each bottle and including bottle-neck engaging means by which the load exerted by the bottle is transferred to the carrier to support the bottle when the carrier is lifted, a wrap-around end wall connecting together lower portions of the side walls at each end of the carrier and providing, together with the lower side wall portions, a peripheral skirt to maintain the bottles in close side-by-side relationship, and tying flaps secured together within the carrier connecting together the side walls to limit movement of the upper side wall portions away from one another.

16 Claims, 5 Drawing Figures

BOTTLE CARRIER WITH PERIPHERAL SKIRT

This invention relates to a bottle carrier of the so-called top-gripping type which has no bottom wall but which grips and supports the bottles by engagement with neck portions of the bottles and which includes a peripheral skirt to maintain the bottles in close side-by-side relationship. More specifically the present invention is concerned with carriers in which bottle-neck receiving apertures are provided in a carrier top wall formed by a hinged connection between a pair of side walls of the carrier.

Skirted top-gripping bottle carriers have been known for some time. For example, U.S. Pat. No. 3,410,596 to Slevin discloses such a bottomless top-gripping carrier in which a plurality of bottles are accommodated, and maintained in close side-by-side relationship by means of a peripheral skirt. However, the Slevin invention is concerned with carriers having bottle-neck receiving apparatus formed in a horizontal top wall which are not prone to the problem of bottle dislodgement caused by movement of the carrier side walls. On the other hand, while this construction is suitable for relatively small and light-weight bottles, it is not sufficiently strong to support heavy bottles such as 2-liter bottles.

Top-gripping carriers having bottle-neck receiving apertures formed in a top wall formed by a hinged construction between a pair of side walls also are known from U.S. Pat. No. 3,016,259 to Lawrence. However, such carriers are not bottomless and do not include a peripheral skirt to confine movement of the bottles.

The present invention seeks to minimize the effect of bottle dislodgement in a carrier of the type referred to due to side wall movement of the carrier. To this end, the invention provides a bottomless carrier for accommodating a plurality of bottles, which carrier comprises a pair of side walls flanking wall portions of the bottles, said side walls including mutually inclined upper portions hinged together adjacent the tops of the bottles and providing a top of the carrier, said top having a bottle-neck receiving aperture for each bottle and including bottle-neck engaging means by which the load exerted by the bottle is transferred to the carrier to support the bottle when the carrier is lifted, a wrap-around end wall connecting together lower portions of said side walls at each end of the carrier and providing, together with lower portions of said side walls, a peripheral skirt to maintain the bottles in close side-by-side relationship, characterized in that at least one tie element connects together the side walls to limit movement of the upper portions thereof away from one another.

Specific embodiments of the invention are now set forth in the following description in conjunction with the accompanying drawings, wherein.

Figure 3:
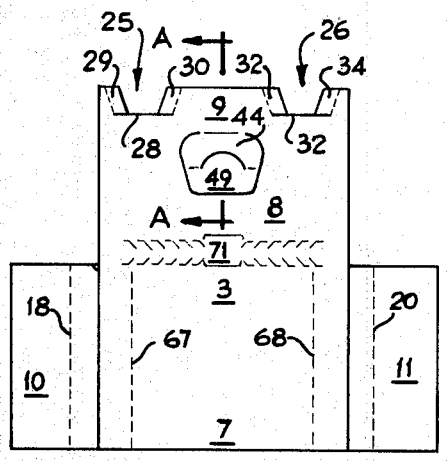
FIG. 3 shows the completed carrier in a collapsed condition.
Figure 3A:
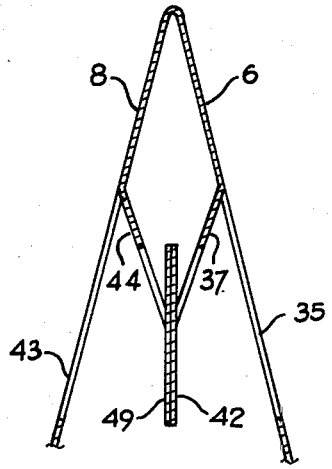
Figure 4:
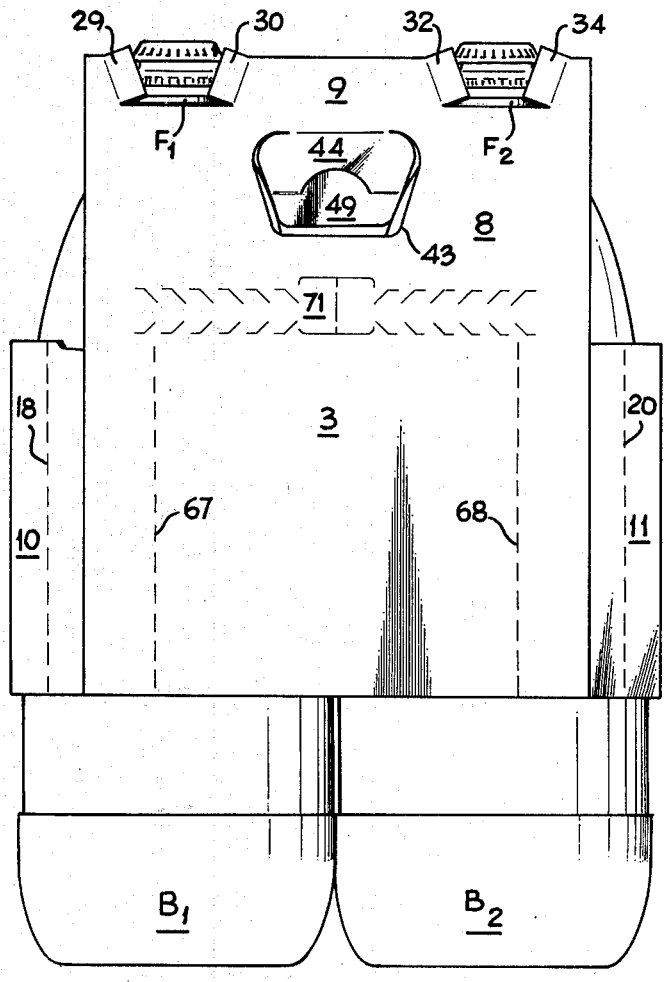

FIG. 3*a* is a sectional view taken along line A—A of FIG. 3, showing the tie element in the carrier handle area; and FIG. 4 is a perspective view of the erected carrier loaded with a pair of bottles.

Figure 1:
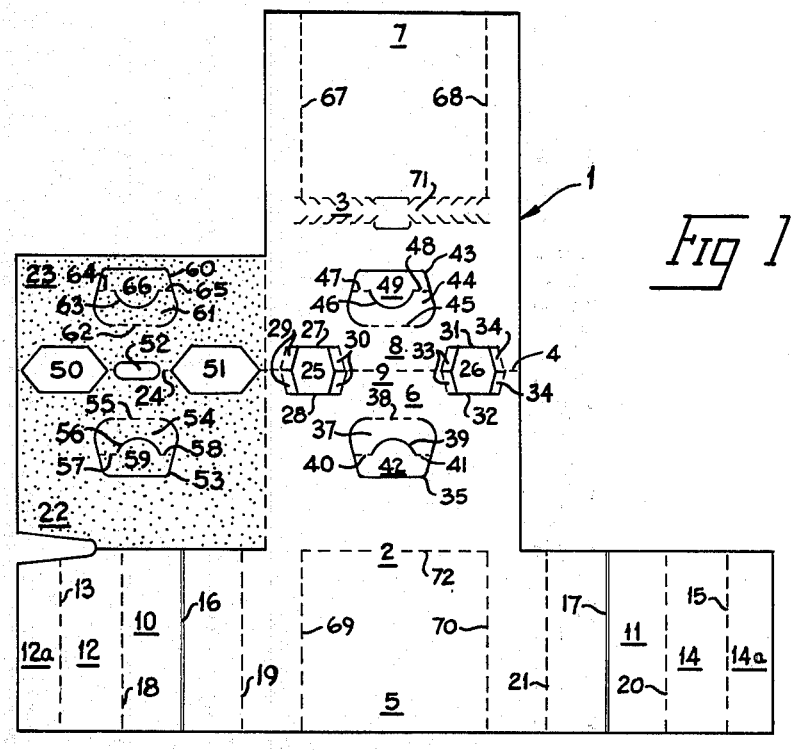
FIG. 1 is a plan view of a blank from which the carrier is formed.

Referring first to FIG. 1, there is shown a flat blank 1 of paperboard (or other suitable sheet material) which is cut and scored and capable of being erected to form a carrier for a pair of bottles as shown in FIG. 4. The blank 1 has a first elongate side wall 2 integrally hinged to a second elongate side wall 3 along a score line 4. Side wall 2 includes a lower portion 5 and an upper portion 6 and similarly side wall 3 includes a lower portion 7 and an upper portion 8. When the carrier is loaded, as shown in FIG. 4, lower side wall portions 5 and 7 extend substantially parallel to one another to flank wall portions of the bottles B1, B2 and upper side wall portions 6 and 8 are mutually inclined to provide a top wall or top 9 of the carrier in the region of score line 4.

The blank also includes wrap-around end wall panels 10 and 11 integral with the first side wall 2 and extending outwardly from opposite side edges thereof remote from the top 9. In order to secure the wrap-around end wall panels 10 and 11 to the side edges of lower portion 7 of the other side wall 3, panel 10 is provided with a glue flap 12 hinged to panel 10 along score line 18. Likewise, panel 11 is provided with a glue flap 14 hinged to panel 11 along score line 20. In order to facilitate folding of the wrap-around end walls, end wall 10 is provided with a fold line 16 and end wall 11 is provided with a fold line 17. When the carrier is loaded, as shown in FIG. 4, the wrap-around end wall panels 10, 11 together with the lower portions 5, 7 of side walls 2, 3, respectively, together provide a peripheral skirt to maintain bottles B1, B2 in close side-by-side relationship. Additionally, to allow each wrap-around end wall to conform closely with the neighboring circumferential wall portion of an adjacent bottle, end wall 10 is formed with a score line 19 extending parallel to fold line 16, and end wall 11 is formed with a score line 21 extending parallel to fold line 17. End wall extensions 12*a* and 14*a*, shown to be joined to glue flaps 12 and 14, respectively, are not essential and could be omitted.

The blank further includes a pair of reinforcement panels 22 and 23 which are integrally hinged together about an interrupted fold line 24 aligned with the score line 4 and which also are integrally hinged to the upper portions 6 and 8 of side wall panels 2 and 3, respectively, about a fold line 4. When the blank is folded to form the completed carrier, as described later, the panels 22, 23 reinforce the upper portions 6, 8 of side walls 2, 3, respectively, and the top wall 9 of the carrier by providing in those areas a double-ply thickness of material.

In a modified construction, in order to minimize the tendency of the reinforcing panels 22, 23 from tearing away from the upper side wall portions 6 and 8 and from top wall 9, the interrupted fold line 24 is offset from but parallel to score line 4. This offset feature facilitates folding of the blank so that the regions of reinforcing panels 22 and 23 adjacent the interrupted fold line 24 are brought into close fitting engagement with the top wall 9 internally of the carrier. In this instance, of course, only reinforcing panel 22 is hinged to the adjacent edge of upper side wall portion 6, whereas reinforcing panel 23 is foldably joined to reinforcing panel 22 along fold line 24 only. In a further modification, reinforcing panel 22 could be hinged to the side edge of upper side wall portion 6 as shown but with the other reinforcing panel 23 hinged to the opposite side edge of upper side wall portion 8 so as to provide a staggered arrangement of the reinforcing panels.

A pair of bottle-neck receiving apertures 25, 26 is struck from the top wall 9 at spaced locations along the fold line 4. Aperture 25 has portions of its periphery defined by a pair of parallel bottle-neck engaging edges 27, 28, respectively, extending parallel to and on opposite sides of score line 4. Aperture 25 includes further peripheral edges extending across score line 4 and interconnecting the ends of the neck engaging edges 27, 28 to which are hinged two sets of side wall strengthening tabs 29, 30, respectively. Similarly, aperture 26 has portions of its periphery defined by a pair of parallel bottle-neck engaging edges 31, 32, respectively, extending parallel to and on opposite sides of score line 4. Aperture 26 also includes further peripheral edges extending across the score line 4 and interconnecting the ends of the neck engaging edges 31, 32, to which are hinged two sets of side wall strengthening tabs 33, 34, respectively.

Side wall 2 includes a hand gripping aperture 35 which is struck from the upper portion 6 of side wall 2 intermediate the bottle-neck receiving apertures 25 and 26. Hand gripping aperture 35 includes a hand cushioning flap 37 which is hinged along a score line 38 to the peripheral edge of aperture 35 adjacent score line 4. The hand cushioning flap 37 is formed with an arcuate cut line 39 which terminates in a pair of short score lines 40, 41, and located intermediate the hinged connection at 38 and the opposite free edge of the flap 37, thereby providing a hinged anchoring tab 42.

Similarly, side wall 3 includes a hand gripping aperture 43 which is struck from the upper portion 8 of side wall 3 intermediate the bottle-neck receiving apertures 25 and 26. Hand gripping aperture 43 includes a hand cushioning flap 44 which is hinged along a score line 45 to the peripheral edge of the aperture 43 adjacent score line 4. The hand cushioning flap 44 is formed with an arcuate cut line 46 which terminates in a pair of short score lines 47, 48, and located intermediate the hinged connection at 45 and the opposite free edge of the flap 37, thereby providing a hinged anchoring tab 49.

The fold line 24 is interrupted by a pair of polygonal bottle-neck receiving apertures 50, 51 which are struck in part from the reinforcement panel 22 and in part from the reinforcement panel 23 at spaced locations along interrupted fold line 24. The bottle-neck receiving apertures 50 and 51 are larger than bottle-neck receiving apertures 25 and 26 and are arranged to be brought into register with the latter when the reinforcement panels 22 and 23 are folded into overlapping relationship with the upper portions 6 and 8 of side walls 2 and 3, respectively. Fold line 24 is further interrupted by an ovate aperture 52 located intermediate bottle-neck receiving apertures 50 and 51 and is provided to facilitate folding of the reinforcement panels 22 and 23 about interrupted fold line 24.

Reinforcement panel 22 includes a hand gripping aperture 53 which is struck from reinforcement panel 22 intermediate the bottle-neck receiving apertures 50 and 51. The hand gripping aperture 53 includes a hand cushioning flap 54 which is hinged along a fold line 55 to the peripheral edge of the aperture 53 adjacent interrupted fold line 24. The hand cushioning flap 54 is formed with an arcuate cut line 56 which terminates in a pair of short fold lines 57, 58, and located intermediate the hinged connection at 55 and the opposite free edge of the flap 54, thereby providing a hinged anchoring tab 59.

Similarly, reinforcement panel 23 includes hand gripping aperture 60 which is struck from reinforcement panel 23 intermediate the bottle-neck receiving apertures 50 and 51. The hand gripping aperture 60 includes a hand cushioning flap 61 which is hinged along a fold line 62 to the peripheral edge of the aperture 60 adjacent interrupted fold line 24. The hand cushioning flap 61 is formed with an arcuate cut line 63 which terminates in a pair of short fold lines 64, 65, and located intermediate the hinged connection at 62 and the opposite free edge of the flap 61, thereby providing a hinged anchoring tab 66.

The hand gripping apertures 53 and 60 are located such as to be brought into registry with hand gripping apertures 35 and 43, respectively, when the reinforcement panels 22 and 23 are folded into overlapping relationship with upper portions 6 and 8 of side walls 2 and 3, respectively.

Figure 2:
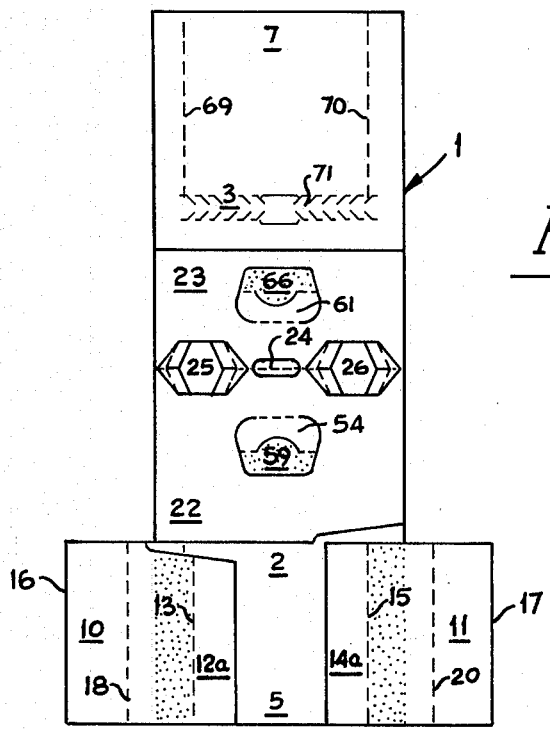
FIG. 2 shows an intermediate stage through which the carrier is manipulated in order to form the completed carrier.

In order to form the completed carrier, glue is first applied to the reinforcement panels 22 and 23 and to the hand cushioning flaps 54 and 61 as shown in stippling in FIG. 1. Following this, the reinforcement panels 22, 23 are together folded upwardly and to the right, as viewed in FIG. 1, and brought into face-to-face relationship with and adhered to upper portions 6 and 8 of side walls 2 and 3, respectively, and to top wall 9. Generally simultaneously or subsequently each of the wrap-around end wall panels 10 and 11 are folded about their respective fold lines 16 and 17 upwardly and inwardly of the blank 1. At the completion of this folding operation the blank has the configuration shown in FIG. 2. It will be appreciated that this folding operation results in the hand gripping apertures 53 and 60 to be brought into registry with hand gripping apertures 35 and 43, respectively, whereby hand cushioning flaps 54 and 61 are adhered to hand cushioning flaps 37 and 44, respectively, thereby providing a pair of double-ply hand cushioning flaps in each of the side walls of the carrier. Likewise bottle-neck receiving apertures 50 and 51 are brought into registry with bottle-neck receiving apertures 31 and 27, respectively. Glue is then applied to each of the glue flaps 12 and 14 and also to those exposed areas of the anchoring tabs 59 and 66, as shown in stippling in FIG. 2. Following this, side wall 3 is folded about the superimposed fold line 24 and score line 4 so that opposed marginal areas of the lower portion 7 of side wall 3 are brought into face contacting relationship and adhered to glue flaps 12 and 14. This folding operation also causes the glued areas of the anchoring tabs 59 and 66 to be adhered together. The blank then has the configuration shown in FIG. 3, which represents the completed carrier in collapsed condition.

Also as shown in FIG. 3 the lower portion 7 of side wall 3 is formed with a pair of parallel score lines 67, 68 spaced from the side edges of lower portion 7 so as to be superimposed on score lines 13 and 15 of wrap-around end wall panels 10 and 11, respectively. Score lines 67 and 68 allow the lower side wall portion 7 to bow outwardly so that it is able to conform more closely to the neighboring wall portions of bottles B1, B2. For a similar reason parallel score lines 69 and 70 are spaced from the side edges of the lower portion 5 of side wall 2 (FIG. 1).

FIG. 3*a* shows in detail the connection between anchoring tabs 49 and 42 which secure together the hand cushioning flaps. For the sake of clarity, reinforcement panels 22 and 23 as well as the reinforcing cushioning flaps 54 and 61 associated therewith have been omitted. It will be appreciated that the connection between the cushioning flaps results in a tie element between the upper portions 6 and 8 of side walls 2 and 3. This tie element restricts movement of side wall upper portions 6 and 8 away from one another so as to maintain the bottle-neck engaging edges of the neck receiving apertures 27, 31 in proper engagement with neck flanges F1, F2 of bottles B1, B2, respectively. Such movement has a tendency to occur when the peripheral skirt rises up the bottle walls thereby causing the upper side wall portions to bow outwardly with the risk of dislodging the bottle-neck engaging edges from their respective neck flanges "F".

Moreover, the hinged connection between the anchoring tab portions of the double-ply hand cushioning flaps together with the hinged connection between the cushioning flaps and the peripheral portions of their respective hand gripping apertures allows the tie element to be brought into a collapsed condition adjacent the top wall 9 internally of the carrier when the carrier is grasped.

However, it is to be understood that the tie element need not be provided by the interconnected hand cushioning flaps, although this is a convenient arrangement. A tie element may be provided by another suitable connection between the side walls at other locations in order to prevent the side wall upper portions from moving apart.

In order to erect the carrier from its collapsed condition it simply is necessary to exert an inward force against one of the wrap-around end wall panels while resisting movement of the other end wall panel, whereafter the carrier can be loaded with a pair of bottles B1, B2 as shown in FIG. 4.

To load the carrier with the bottles B1 and B2 the carrier is pushed downwardly over a pair of suitably aligned bottles so that they enter neck first through the bottomless end of the carrier until such time as neck portions of the bottles protrude through the respective neck receiving apertures 51, 25 and 50, 26. In so doing the pairs of side wall strengthening tabs 29, 30 and 33, 34 are displaced upwardly to rest against exposed portions of the respective bottle-necks. The bottle-neck flanges F1 and F2 are then engaged by the bottle-neck engaging edges 27, 28 and 31, 32 of the neck receiving apertures 25, 26, respectively, by which the load exerted by the bottles is transferred to the carrier in order to support the bottles when the carrier is lifted.

It will be appreciated that each of the wrap-around end wall panels 10 and 11 is sized to contain the bottles snugly within the carrier and thus the lower portions 5 and 7 of the side walls 2 and 3 together with the wrap-around end wall panels 10 and 11 provide a close fitting peripheral skirt encircling the bottles.

In order to provide access to the bottles a tear away strip 71 is provided across the junction between the upper portion 8 and the lower portion 7 of side wall 3. Tear away strip 71 also provides a weakened area across the side wall 3 which assists in allowing the upper portion 8 of the side wall to adopt its inclined attitude. For a similar reason, a fold line 72 is provided across the junction between the upper portion 6 and the lower portion 5 of side wall 2.

What I claim is:

1. A bottomless carrier for accommodating a plurality of bottles arranged in close side-by-side relationship, which carrier comprises a pair of opposing side walls flanking wall portions of the bottles, said side walls including mutually inclined upper portions directly hinged together and providing a top of the carrier, said top having a bottle-neck receiving aperture for each bottle and including bottle-neck engaging means provided by said upper portions of the side walls to support the bottle when the carrier is lifted, an end wall connecting together lower portions of said side walls at each end of the carrier and providing, together with lower portions of said side walls, a peripheral skirt to maintain the bottles in close side-by-side relationship, characterized in that at least one tie element connects together said upper portions of the side walls to limit movement of said upper portions away from one another.

2. The bottomless carrier according to claim 1 adapted for two bottles, comprising a pair of bottle-neck receiving apertures provided in said top and a hand gripping aperture formed in the upper portion of each side wall intermediate said pair of bottle-neck receiving apertures, each of said hand gripping apertures being aligned with the hand gripping aperture formed in the other of said side walls.

3. The bottomless carrier according to claim 2 further characterized in that each of said bottle-neck receiving apertures is provided with top strengthening tabs hinged to peripheral portions of the bottle-neck receiving apertures which interconnect said bottle-neck engaging means, said top strengthening tabs of each bottle-neck receiving aperture being upwardly displaced by and engaged with a neck portion of a bottle received in that aperture.

4. The bottomless carrier according to claim 3 further characterized in that said bottle-neck engaging means for each bottle-neck receiving aperture comprises peripheral edge portions of that aperture, said peripheral edge portions being substantially parallel to one another and to the hinged connection between said side walls.

5. The bottomless carrier according to claim 2 further characterized in that each hand gripping aperture has a hand cushioning flap hinged along a peripheral portion thereof, said hand cushioning flaps being connected together internally of the carrier and constituting said tie element.

6. The bottomless carrier according to claim 5 further characterized in that at least one of said hand cushioning flaps is scored intermediate its hinged connection and an opposed free edge thereof so as to provide an anchoring tab remote from said hinged connection for securing said hand cushioning flaps together, and in that said hand cushioning flaps are foldable about said anchoring tab and about their hinged connections to allow the hand cushioning flaps to be brought into a collapsed condition internally of the carrier.

7. The bottomless carrier according to claim 5 further characterized in that a reinforcement panel is hinged to the upper portion of each side wall and secured in overlapping relationship with respect thereto internally of the carrier, said reinforcement panels being hinged together and provided with bottle-neck receiving apertures along their hinged connection, which apertures are located in registry with the bottle-neck receiving apertures provided in said top, and in that each of said reinforcement panels includes a hand gripping aperture located in registry with the hand gripping aperture provided in that adjacent side wall.

8. The bottomless carrier according to claim 7 further characterized in that each of said reinforcement panel hand gripping apertures has a hand cushioning flap hinged along a peripheral portion thereof, which flap is secured to the hand cushioning flap hinged along a peripheral portion of an adjacent side wall hand gripping aperture thereby providing a double-ply hand cushioning flap in each side wall of the carrier, said double-ply hand cushioning flaps being secured together internally of the carrier to provide said tie element.

9. The bottomless carrier according to claim 8 further characterized in that adjacent faces of the reinforcement panel hand cushioning flaps are secured together so as to connect one of said double-ply hand cushioning flaps to the other of said double-ply hand cushioning flaps.

10. The bottomless carrier according to claim 9 further characterized in that the hand cushioning flaps providing each of said double-ply hand cushioning flaps are cut and scored intermediate their respective hinged connections and opposed free edges thereof so as to provide for each double-ply hand cushioning flap a foldable anchoring tab remote from said hinged connections, by which anchoring tabs said double-ply hand cushioning flaps are secured together, and in that said double-ply hand cushioning flaps are foldable about said anchoring tabs and about said hinged connections to allow the double-ply hand cushioning flaps to be brought into a collapsed condition adjacent said top wall internally of the carrier.

11. The bottomless carrier according to claim 1 further characterized in that each of said end walls is integral with the lower portion of one of said side walls and is secured to an adjacent lower portion of the other of said side walls, and in that each end wall is provided with a plurality of fold lines to allow that end wall to conform closely with the cylindrical wall portion of an adjacent bottle.

12. A unitary carrier blank formed from foldable sheet material comprising a pair of side wall panels having upper portions directly hinged together along a fold line, a plurality of bottle-neck receiving apertures provided at spaced locations along said fold line, each aperture including bottle-neck engaging means provided by said side walls adjacent said fold line, end wall panels integral with said side walls remote from said fold line and extending in opposite directions from side edges of said side walls, characterized by tying means provided adjacent said fold line for connecting together said upper portions of said side walls when the carrier is assembled.

13. The unitary carrier blank according to claim 12 comprising a pair of bottle-neck receiving apertures provided at spaced locations along said fold line between said side walls, and a hand gripping aperture formed in each of said side walls intermediate said bottle-neck receiving apertures adjacent said fold line, each of the hand gripping apertures being provided with a hinged hand cushioning flap adapted to be secured to the other hand cushioning flap and together constituting said tying means.

14. The unitary carrier blank according to claim 13 further characterized by a reinforcement panel hinged along a side edge of each of said side wall panels and adapted to be folded into overlapping relationship to reinforce the upper portions of said side walls, said reinforcement panels being provided with bottle-neck receiving apertures and hand gripping apertures located so as to be brought into registry with respective ones of the bottle-neck receiving apertures and hand gripping apertures provided along said fold line and in said side walls, respectively, when the reinforcement panels are folded into overlapping relationship.

15. A bottomless carrier accommodating a pair of bottles arranged in close side-by-side relationship, which carrier comprises a pair of opposing side walls flanking wall portions of the bottles, said side walls including mutually inclined upper portions directly hinged together adjacent the tops of the bottles and providing a top of the carrier, said top having a bottle-neck receiving aperture for each bottle and including bottle-neck engaging means provided by said upper portions of the side walls to support the bottles when the carrier is lifted, an end wall connecting together lower portions of said side walls at each end of the carrier and providing, together with lower portions of said side walls, a peripheral skirt to maintain the bottles in close side-by-side relationship, characterized by hand gripping apertures formed in the upper portions of said opposing side walls intermediate the bottle-neck receiving apertures and aligned with each other, and by reinforcement panels disposed in overlapping relationship with said top of said carrier internally thereof, said reinforcement panels being provided with bottle-neck receiving apertures and with hand gripping apertures located in registry with respective ones of the bottle-neck receiving apertures and with respective ones of the hand gripping apertures formed in said top and said side walls, respectively.

16. The bottomless carrier according to either claim 1 or claim 2, further comprising reinforcement panels secured in overlapping relationship with each of said two side walls internally of the carrier, one of said reinforcement panels being hinged to a side edge of one of said side walls and the other of said reinforcement panels being foldably joined to said one reinforcement panel along a fold line which is offset from said hinged connection between the upper portions of said side walls.

* * * * *